US007967735B2

(12) United States Patent
Hudswell et al.

(10) Patent No.: US 7,967,735 B2
(45) Date of Patent: Jun. 28, 2011

(54) EXERCISE DEVICE WITH AN AUDIBLE SIGNAL PRODUCING FORCE INDICATOR

(75) Inventors: Michael Roy Hudswell, Nottinghamshire (GB); Ian Harrison, Monmouthshire (GB)

(73) Assignee: Inneva Ltd., Derby (GB)

( * ) Notice: Subject to any disclaimer, the term of this patent is extended or adjusted under 35 U.S.C. 154(b) by 0 days.

(21) Appl. No.: 12/444,621

(22) PCT Filed: Oct. 12, 2007

(86) PCT No.: PCT/GB2007/003900

§ 371 (c)(1),
(2), (4) Date: Apr. 7, 2009

(87) PCT Pub. No.: WO2008/044051

PCT Pub. Date: Apr. 17, 2008

(65) Prior Publication Data

US 2010/0048365 A1 Feb. 25, 2010

(30) Foreign Application Priority Data

Oct. 12, 2006 (GB) ..... 0620232.9

(51) Int. Cl.
*A63B 21/02* (2006.01)

(52) U.S. Cl. ..... 482/121

(58) Field of Classification Search ..... 482/1, 8, 482/121–126, 139, 909
See application file for complete search history.

(56) References Cited

U.S. PATENT DOCUMENTS

| | | | | |
|---|---|---|---|---|
| 3,498,609 | A | 3/1970 | Lukens | |
| 4,846,462 | A * | 7/1989 | Regnier et al. | 482/1 |
| 5,141,481 | A * | 8/1992 | Kolbel | 482/126 |
| 6,001,050 | A * | 12/1999 | Delf | 482/122 |
| 2004/0011277 | A1 | 1/2004 | Barnes et al. | |
| 2005/0006934 | A1 | 1/2005 | Rabeony et al. | |
| 2005/0040960 | A1 | 2/2005 | Knox | |
| 2005/0148447 | A1 * | 7/2005 | Nady | 482/121 |
| 2007/0105696 | A1 * | 5/2007 | Castel et al. | 482/121 |

FOREIGN PATENT DOCUMENTS

| | | | |
|---|---|---|---|
| EP | 1468868 | A | 10/2004 |
| EP | 1468868 | A2 | 10/2004 |
| GB | 2031285 | A | 4/1980 |
| GB | 2315422 | A | 2/1998 |
| WO | WO2006/059114 | A1 | 6/2006 |
| WO | WO2007/129079 | A1 | 11/2007 |

* cited by examiner

*Primary Examiner* — Fenn C Mathew
(74) *Attorney, Agent, or Firm* — Dickinson Wright PLLC

(57) ABSTRACT

An exercise device (20) comprising a resilient force member (6) which is arranged to be acted on by a user and provide resistance against movement by a user over an operative range. The exercise device (20) further includes a mechanical indicator device (1) which directly provides an audible signal at both first and second points of the operative range of the force member (6) to thereby indicate movement of the force member over a required range. The indicator device (1) comprising an audible signal producing member (9) having bistable first and second physical configurations such that a change in physical configuration creates an audible signal. The audible signal producing member (9) being acted on by the resilient force member (6), in use, to change the physical configuration of the audible signal producing member (9) and produce the audible signal.

21 Claims, 4 Drawing Sheets

EXERCISE DEVICE WITH AN AUDIBLE SIGNAL PRODUCING FORCE INDICATOR

BACKGROUND OF THE INVENTION

1. Field of the Invention

The present invention relates to an exercise device with an indicator that indicates a determined level of force application, and more specifically that a range of operation, has been achieved.

2. Related Art

A common type of exercise device includes a tensionable, or compressible, resilient force member (for example an elastic band or spring) which is repeatedly extended, or compressed, by a user over a range of movement. The tensionable, or compressible, member provides a resistance to such movement against which the user works to exercise their muscles. The user may extend or compress the tensionable, or compressible, member using arms, legs or various part of the body via suitable handles or other arrangements attached to the tensionable, or compressible, member. There are a variety of such devices, with the simplest comprising an elastic band as a tensionable member, the band having handles at either end.

In order to ensure a consistent and rigorous exercise or 'work out' with such an-exercise device it is important that the user fully and consistently extends, or compresses, the tensionable, or compressible, member over the complete and consistent optimum range, between set maximum and minimum operating extension (or compression) points. Equally it is important that a user does not over extend, or compress, the device and thereby over extend the device and/or their muscles. It is therefore known to provide such exercise devices with indicators. Such indicator arrangements are however generally large and cumbersome having complex indicating means and are often difficult to adjust. They also may not provide a complete and adequate indication of the use of the exercise device.

An example of such an exercise device with an indicator arrangement is shown in US 2007/0105696. This describes two separate main indicator arrangements. In the first arrangement a complex image or pattern (for example a halftone, Pointillist or Moire image) is printed on an elastic band which distorts or changes to a different pattern when a predetermined tension and stretch is applied to the band. While this provides an indication of the tension, it requires the printing of a complex pattern which can be difficult. In addition since the image is printed on the band, the indicator cannot be easily adjusted to provide an indication of different tension levels, and different bands are required for each different tension and extension settings. More fundamentally a user must carefully watch the image distort to see when the different pattern or image appears indicating that the required tension and extension has been achieved. This can be difficult while exercising, and also restricts the exercises that a user can complete with the device. For example, a user cannot use the device behind their back. In the second indicator arrangement shown in US 2007/0105696, an electronic indicator is proposed which provides a visual and/or audible signal when a required tension, and so extension of the elastic band is achieved. Such an electronic indicator addresses some of the problems of the first arrangement, but adds significant complexity, cost and also weight. In addition it only provides an indicator signal at the set maximum tension and extension.

It is therefore desirable to provide an improved exercise device including an indicator arrangement which addresses the above described problems and/or which more generally offers improvements or an alternative to existing arrangements.

SUMMARY OF THE INVENTION

In particular a desirable object of this invention is to provide an improved exercise device, of the simple type, including a tensionable (or compressible) resilient force member, which is compact, simple, and relatively cheap yet which also has the ability to provide an indication of when a pre-determined level of force has been applied, and an indication of when the entire required range of movement (extension of compression) of the tensionable (or compressible) member has been achieved. The device should also preferably have the ability to adjust the indicated force and/or extension (or compression) allowing different levels of force and extension to be indicated and set.

According to the present invention there is therefore provided an exercise device, and an indicator for an exercise device, as described in the accompanying claims.

In an embodiment of a first aspect of the invention there is provided an exercise device comprising a resilient force member arranged to be acted on by a user and provide a resistance against movement by a user over an operative range; and an indicator device which provides, in use, an audible signal at both a first and second points of the operative range of the force member.

Such an arrangement provides an indication to a user that they have correctly operated the exercise device over the full operating range, thereby ensuring that the exercise device is correctly used.

The first and second points preferably correspond to a first and second resistance force provided by the resilient force member. The first and second points may correspond to first and second lengths or settings of the resilient force member.

In an embodiment of a second aspect of the invention there is provided an exercise device comprising a resilient force member arranged to be acted on by a user and provide resistance against movement by a user over an operative range; and a indicator device comprising audible signal producing member having first and second physical configurations and which is acted on by the resilient force member, in use, to change the physical configuration of the audible signal producing member, wherein the change in physical configuration creates an audible signal.

This arrangement provides in a simple, reliable and cheap manner a simple audible indication to a user that they have operated the exercise device over the operative range.

Preferably the audible signal producing member creates an audible signal both as it changes from the first to the second physical configuration and as it changes from the second to the first physical configuration.

The audible signal producing member is preferably adapted to change from the first to the second physical configuration when acted on by a load above a first threshold. The audible signal producing member is also preferably adapted to remain in the second physical configuration only when acted on by a load above the first threshold. The audible signal producing member may be furthermore adapted to change back from the second to the first physical configuration when acted on by a load below a second threshold.

The audible signal producing member may be adapted to change from the first to the second physical configuration when acted on by a load at a first threshold, and to change from the second to the first physical configuration when acted on by a load at a second threshold, wherein the first and second load thresholds are different.

Preferably the second threshold is below the first threshold.

The exercise device may further comprise an adjuster for adjusting when, under the action of the resilient force member, the audible signal producing member changes from the first to the second physical configuration.

The audible signal producing member preferably has a bistable stress-strain state, and the first and second physical configuration comprise first and second stable stress strain states of the audible signal producing member.

The audible signal producing member may comprise a deflection member, and the resilient force member acts on the deflection member to deflect the deflection member. The resilient force member acts on the deflection member at an angle to the deflection member, and the device further comprises an adjuster which varies the angle at which the resilient force member acts on the deflection member.

The audible signal producing member and in particular the deflection member preferably comprises a plate with a dimple, and the dimple inverts between, and defines, the first and second physical configurations.

In accordance with another aspect of an embodiment of the invention the device has a tensionable elongate member and a force indicator in line with the elongate member adapted to indicate that a preset force has been achieved. The tensionable elongate member is preferably an elastic strap, but can be non-elastic, and can be of any cross section.

In an embodiment, the force indicating means is a steel spring mounted on the strap, with a built in bi-stable stress-strain state such that it emits a sharp acoustic click when distorted by the strain applied to the strap.

The exercise device can be enhanced with clips for adjusting the length of the strap and various handles and accessories for modifying the type of exercise that can done.

BRIEF DESCRIPTION OF THE DRAWINGS

The present invention will now be described by way of example only with reference to the following figures in which.

DETAILED DESCRIPTION OF THE PREFERRED EMBODIMENT

Figure 1:
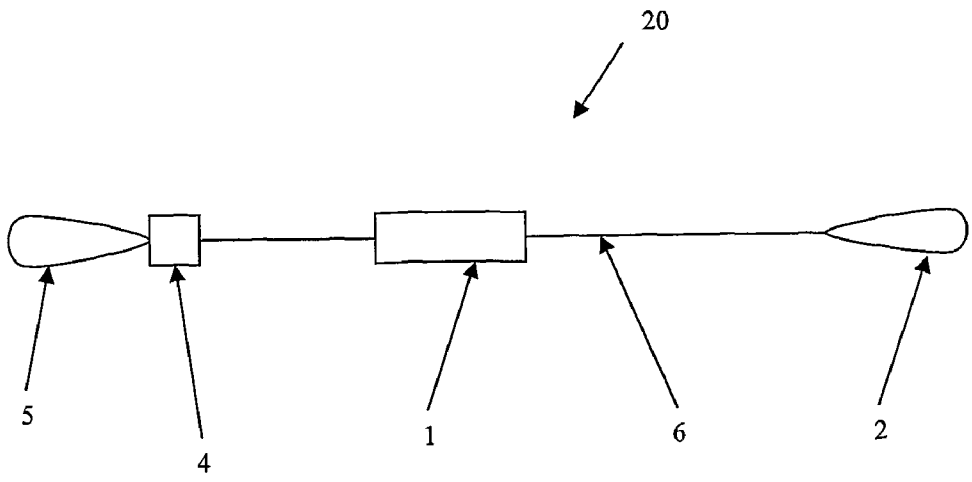
FIG. 1 is a schematic block diagram illustration of the exercise device including an indicator device, of an embodiment of the invention.

In the following description of the invention, certain terminology will be used for the purpose of reference only, and are not intended to be limiting. Terms such as "upper", "lower", "above", "below", "rightward", "leftward", "clockwise", and "counterclockwise" refer to directions in the drawings to which reference is made. Terms such as "inward" and "outward" refer to directions toward and away from, respectively, the geometric center of the component described. Terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Referring to FIGS. 1 to 4, in accordance with an embodiment of the invention, an exercise device 20 comprises resilient force member 6, in this case an elastic strap, connected at one end to a handle 2. The strap 6 is connected and passes through (as shown in more detail in FIG. 2) an indicator device 1 and is connected at the other end via an adjustment clip 4 to a loop 5. In other more preferred embodiments the resilient force member 6 may terminate before the indicator 1, and be connected to a separate, non-elastic strap that then passes through the indicator device to the adjustment clip 4. Similarly the resilient force member 6 may be connected via a non-elastic strap, or indeed further adjustment clip 4 to the handle 2. The adjustment clip 4 may also be omitted, and the loop and handles replaced or interchanged. The indicating device 1 can be mounted at any point along the elastic strap 6, although it is preferable to mount the indicating device at one end adjacent the handle 2 (or loop 5).

In use a tension force is applied to exercise device 20, and resilient force member 6, in a conventional manner for such a type of exercise device, typically but not exclusively by a user using and variously holding the loop 5 and the handle 2, to thereby stretch and extend the resilient force member 6. For example a user may place their foot in the loop 5 and then hold onto the handle with their hand and pull to stretch and extend the elastic strap 6. The resilience of the elastic strap 6 provides a resistance against the extension and movement applied by the user against which a user works to thereby exercise their muscles.

The initial unextended length of the elastic strap 6 may be adjusted by means of the adjustment clip 4 to suit the particular exercise and range of movement required.

Figure 2:
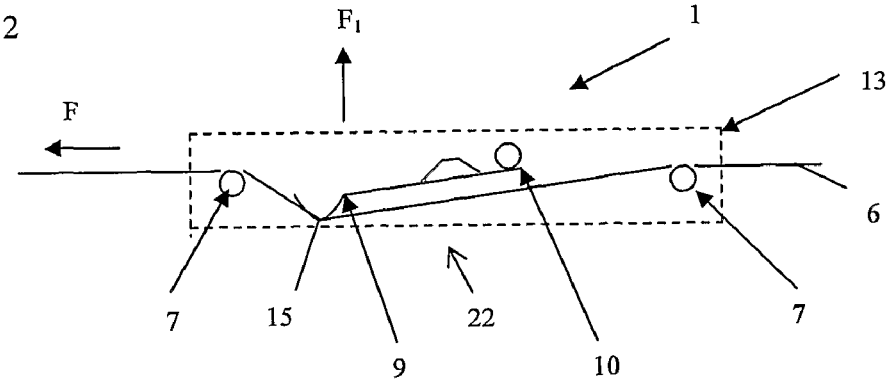
FIG. 2 is a schematic more detailed illustration of the indicator device of FIG. 1.

The indicator device 1 is shown in more detail in FIG. 2. The indicator 1 is similar to, and may be replaced with the indicator device described in GB 0608994.0 filed 5 May 2006, and GB 0623344.9 filed 23 Nov. 2006, and PCT/GB2007/001673 filed 8 May 2007 which are incorporated herein by reference.

The indicator device 1 comprises a plastic outer housing 13 within which there is mounted an audible signal producing member, and a pair of guides 7 at either end of the housing for guiding the strap 6 through the indicator 1. The audible signal producing member comprises a deflection member in the form of a steel spring plate 9 which is mounted and fixed at one end 10, and has a distal end which includes a curved abutment surface 15. The elastic strap passes through the indicator device 1 over the guides 7 and abutment surface 15 at the end of the steel spring plate 9, and is constrained by them. As shown in FIG. 2 the abutment surface 15 of steel plate 9 diverts the elastic strap 6 from a straight line between the guides 7, with the steel spring plate 9 being disposed within the housing 13 at an angle, and holding the strap 6 at a corresponding angle α to the straight line of the strap 6 passing through the indicator device 1. In this way, the strap 6 is guided along an extended path around the abutment surface 15 inside housing 13.

Figure 3:
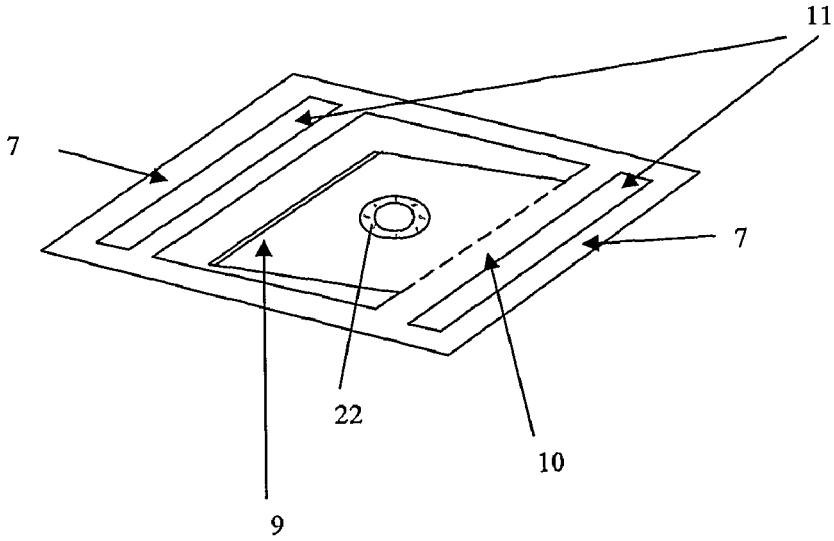
FIG. 3 is a more detailed perspective schematic illustration of the spring plate of the indicator device shown in FIG. 2.
Figure 4:
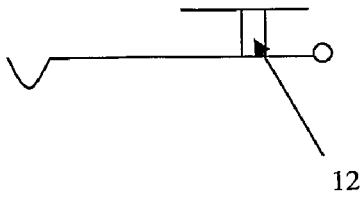
FIG. 4 is a schematic illustration of an alternate spring plate arrangement of the indicator device of FIG. 2 which incorporates an adjuster arrangement of the indicator device.
Figure 7:
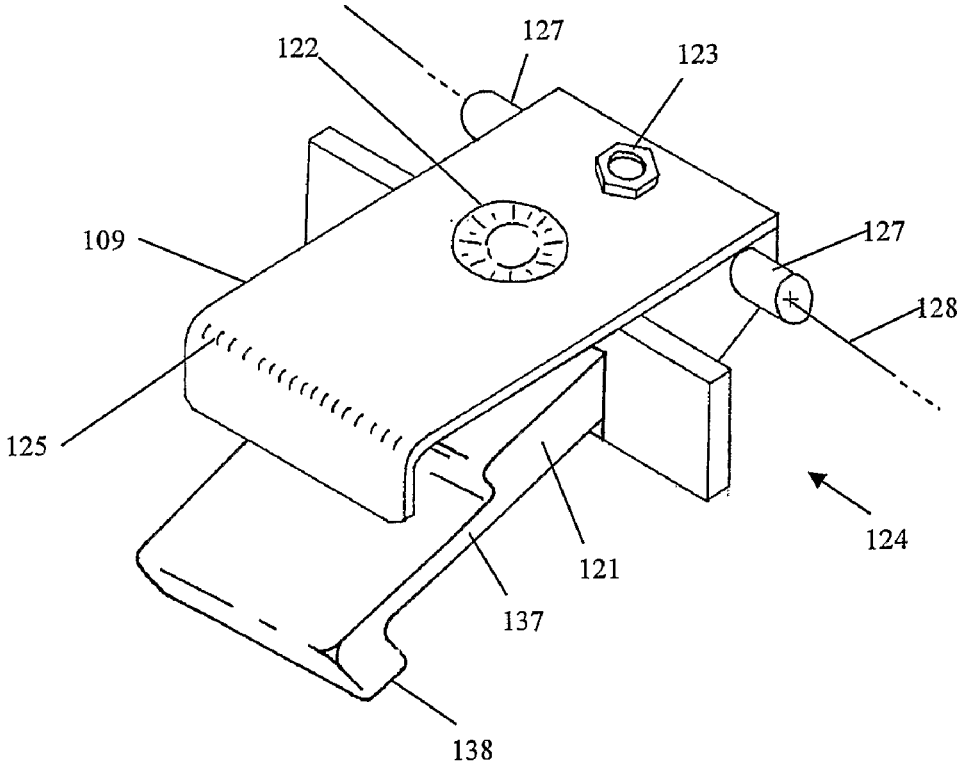
FIG. 7 is a perspective view of just the spring plate and holder of the indicator device shown in FIGS. 5 and 6.
Figure 5:
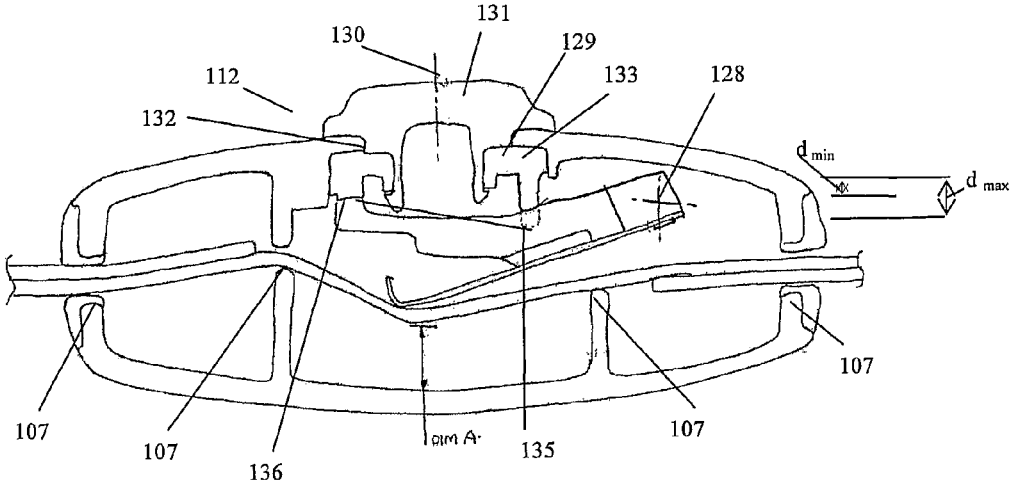
FIG. 5 is a cross sectional view through an indicator device, shown schematically in FIGS. 1 to 4 above, of a particular embodiment of the invention, with the indicator device adjusted to indicate a high load and extension.
Figure 6:
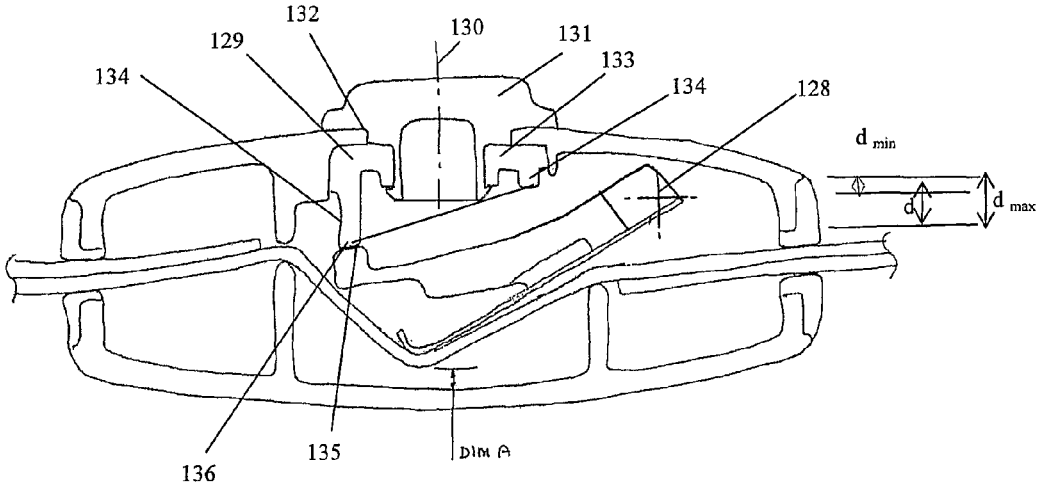
FIG. 6 is a cross sectional view through an indicator device, similar to that of FIG. 5 above, but with the indicator device adjusted to indicate a low load and extension.
Figure 8:
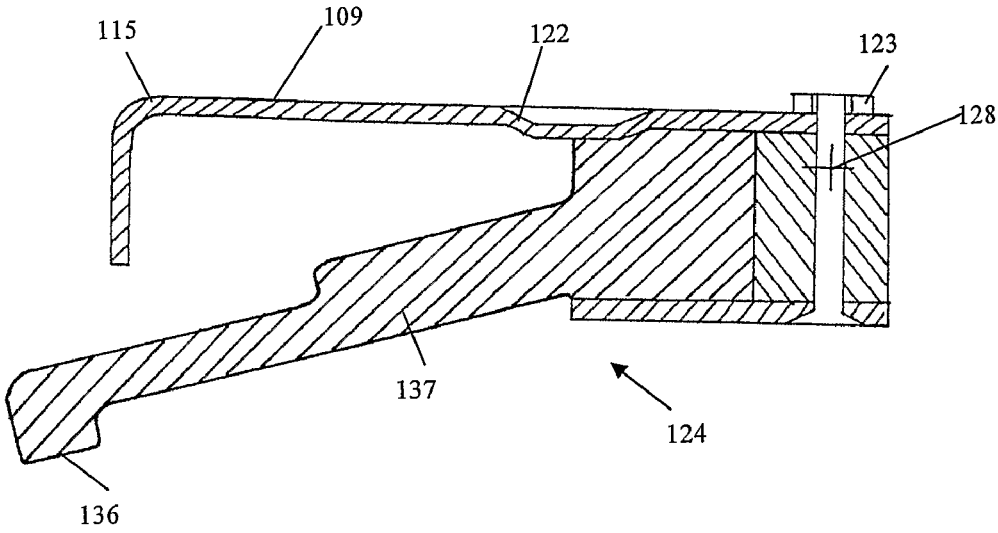
FIG. 8 is a cross sectional side view of just the spring plate and holder of the indicator device shown in FIG. 7.

As shown in FIG. 3, in the simplest form the spring plate 9 is formed integrally with the guides 7, and in this case is stamped from a single metal plate which has window apertures 11 through which the strap 6 is threaded with an edge of each of the windows 11 forming the guides 7 to control the path of the strap 6. In other embodiments, for example as shown in FIGS. 5 to 8, the guides 7 may be separate to the audible signal producing member 9, and may comprise parts of the housing 13.

In use, a tension force F applied by a user to the elastic strap 6 acts on the abutment surface 15 and distal end of the steel plate 9. The tension acting on the strap 6 urges the strap to move to a straightened path. In doing this, the strap 6 applies a force F1 to the abutment surface 15 of plate 9. This force F1 is a function of the tension force and angle of the steel plate 9 and is equal to the tension force F multiplied by sine α (F sin α). This tension force, and resultant force F1 act to bend and deflect the spring plate 9 and place it under strain and load. When the tension in the strap 6 is reduced, the spring plate 9 reverts back to its normal position, thereby moving the strap 6 from its shorter path back to its extended path, and the strain and loading of the plate 6 is released. The spring plate 9 is specifically configured and adapted to produce an audible acoustic click as it transitions from an undeflected and unloaded state to a deflected and loaded state, and also as it transitions back again to an undeflected and unloaded/strain state. This is explained further below.

Specifically the spring plate 9 is pre-stressed and exhibits two bistable stress-strain states. The acoustic signal is caused by the rapid change from one strain condition to another strain condition as the spring plate 9 moves between the unloaded and undeflected condition and a deflected and loaded condition. The rapid change in particular causes an acoustic shock wave to emanate from the spring plate 9. The transition from one strain condition to the other, occurs rapidly over an intermediate unstable state condition. The pre-stressing may be achieved in a number of different manners. For example it may be achieved by curving and forming the spring plate 9 in one or more directions to create a concavity in part, or over a large area of the plate 9, or even over the entire plate 9. This concavity or curving is configured and arranged such that when the plate is bent, in a different direction and about a different axis to the curving and/or concavity, the concavity and/or curvature of the plate 9 rapidly inverts. In particular the spring plate 9 can be formed to have a concave spring profile in one, two or more planes. Similarly the plate could be formed to have any structure or shape (for example being dished) that is arranged to invert in shape when the plate 9 is bent. The inversion of the structure and part of the plate 9 thereby providing the first and second physical configurations. In this particular preferred embodiment the pre-stressing may be by means of providing a stamped depression 22 close to the centre of and stamped in the spring plate 9. The depression 22 has an essentially concave/convex profile and it can exist as a convex profile unloaded and invert into a concave profile when loaded. In other words the plate 9 and depression 22 has two physical configurations. The change from one profile to another when loaded is sufficiently rapid to cause a compression of air on the concave side and the resultant shock wave produces an acoustic click.

The change from concave to convex and the acoustic emission occurs as the plate 9 is bent and deflected under the loading by the strap 6, and so at a predetermined set force, and first threshold, on the abutment surface 15 to sufficiently bend the plate 9 until the change occurs. The spring plate 9 itself is also resilient, and will tend to oppose the bending and distortion under the loading of the strap 6. Accordingly when the tension in the strap 6 is reduced, the spring plate 9 will straighten and become unloaded thereby moving the belt 2 from its shorter path back to its extended path. During this return movement, the depression 22 will revert from the convex back to the concave state and will produce a second sharp acoustic signal. This second signal is preferably audibly different from the first signal. The spring plate 9, and bistable configuration, and in this case depression is however configured to exhibit hysteresis. Specifically the bending and loading on the spring plate 9, and hence tension in the strap 6 at which the spring plate 9 reverts back to its original state is different, and at a different second threshold to that at which it initial change in state under loading occurs. In particular the spring plate 9 typically and preferably reverts back to its original state at a much lower deflection, loading and tension, and only when substantially fully unloaded. The spring plate 9, once it has changed state, remains in the changed state so long as the tension is above this second lower threshold and at a much lower loading than is required to initially change the state, and produce the first click. This allows for a difference in the tension level at which the spring plate 9 changes state and emits the audible click. That is, the threshold at which the spring plate 9 reverts back its initial state is at substantially lower level than that the level required to move it to the changed state. In this sense, the spring plate 9 is semi-stable once in its changed state, and is stable in its initial state.

Figure 9:
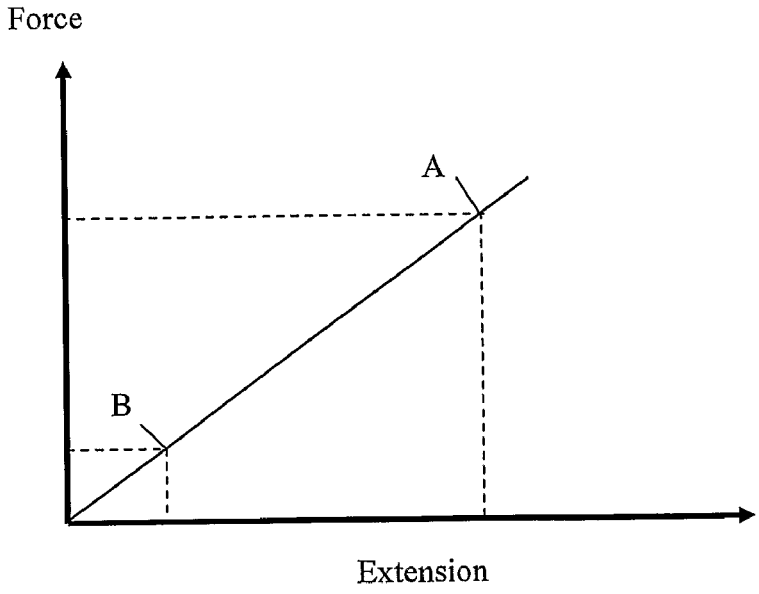
FIG. 9 is a graph showing the variation of the applied force against extension as the exercise device is extended in use, and showing the points at which the indicator device operates.

As a result the indicator 1 advantageously emits the first click when the strap 6 is tensioned to the first maximum tension and extended position, and than emits the second click when the strap 6 is substantially fully relaxed, back at the initial unextended position, and at the much lower tension, and thereby substantially at either end of the operative range of extension and tensions a user applies to the strap 6 and exercise device 20. As a result the indicator 1 provides an indication at both ends of the operative range of extension of the resilient strap 6 to indicate to a user that they have completed the full operation of the device 20. This is indicated in FIG. 9 where points where the first and second click, and first and second thresholds at which the spring plate 9 changes state, are marked as A and B respectively against the tension force and extension of the strap 6.

The threshold loadings at which the spring plate 9 changes state is dependant upon the degree of concavity of the depression formed in the spring plate 9 and the thickness and property of the material. The threshold is a fixed value for a particular spring plate 9 assembly. However the actual force F1 applied to the spring plate 9 is dependant upon both the tension force in the strap 6 and the dimensions of the path of the strap 6 around the guides 7 and the abutment surface 15 on the end of the spring plate 9. In particular it is dependent on the angle α of the strap 6, set by the angle of the spring plate 9. The tension force F in the strap 6 at which spring plate 9 changes state and emits the first acoustic click can therefore be set and varied by setting and varying the angle of the spring plate 9. In a typical arrangement the indicator can be variably and adjustably set to emit the first click at any tension of anywhere between 8ON and 2ON applied by a user to the strap 6. This allows a user to set the point where the click indicates maximum extension or load, and end point, and so in effect by exercising until the click is heard the operative range for the exercise is achieved, with the first click being at the maximum required extension/load. The second click is emitted when the strap 6 is substantially fully relaxed and substantially under zero tension at all times and is not generally adjusted or adjustable.

In order to adjust and vary the tension at which the indicator 1 emits a click, the indicator 1 preferably includes an adjuster 12 to, as explained above, vary the angle of the spring plate 9, and so angle α of the strap 6 within the housing 13. Such an adjuster 12 is shown schematically in FIG. 4. The adjuster 12 may comprise a cam or screw acting between the spring plate 9 and a fixed point in the indicator housing 13. The cam or screw alters the distance between the fixed point and the spring so that the start point, and initial angle, of the abutment surface 15 of the end of the spring plate 9 is altered in the vertical direction. This modifies the angle α of the strap 6 and so the proportion of the strap tension force F to which the spring plate 9 reacts. This cam or screw can have a graduated scale so that the user can adjust the force, and first threshold, at which the indicator 1 produces the first acoustic click. It will be appreciated that a suitable adjuster 12 may be provided in a number of other ways, for example by moving the guides 7 and/or moving the entire spring plate 9 to similarly vary the angle, and proportion of the tension force F applied.

It is possible to include a counter (not shown) within the indicator 1 that registers the acoustic clicks and/or operation of the spring plate 9 to in conjunction with the acoustic clicks indicating full operation of the device 20 also tells the user how many repetitions and extensions of the exercise device 20 have been completed, and so how much exercise has been done.

The housing 13 may also comprise a flexible compressible surface on the under-side of the outer housing 13 of the indicating device 1 to allow a user to compress the flexible surface of the housing 13 and press against and directly deflect the spring plate 9 to provide the same acoustic signal that is achieved by the tension force F on the strap 6. This will enable the user to check that the indicator 1 is working properly, and to recognise the audible signal. Additionally, and in an alternative embodiment, this arrangement, and the indicator device 1 itself on its own can be used as an exercise device for example for exercising the fingers or hands. In this case the resilient member comprises the remainder of the spring plate 9 and the resilience of the spring plate 9 which opposes and resists a load trying to deflect it. The user simply then compresses the flexible surface, pressing against and deflecting the spring plate 9 directly, with the clicks being emitted similarly when the plate 9 is fully bent and loaded and when unloaded. The actual resistance can then be varied by varying the angle of the spring plate 9 as well as varying the point at which the click are emitted.

FIGS. 5 to 8 show, in more detail, an alternative indicator device 101 for use in the exercise device 20 arrangement shown in FIG. 1. The indicator device 101 is generally similar to the indicator device 1 shown in FIG. 2, and like reference numbers incremented by 100 will be used to reference to corresponding features. In addition only the main difference will now be described with the indicator 101 of FIGS. 5 to 8 operating in a similar manner.

The indicator device 101 comprises a plastic housing 113 comprising upper and lower halves 113*a*, 113*b* which are fixed together with the strap 106 passing between then through openings cooperatively formed at either end. The housing 113 includes guide ribs 107 which support the strap 6 and upon which the strap 6 rests. In this embodiment a metal spring plate 109 is mounted at one end by a fastener 123 onto a spring plate carrier 121 to form a spring plate assembly 124 shown on its own in FIGS. 7 and 8. Of course the spring plate 109 could be attached to the carrier 121 in a number of other ways, and using different fasteners and fastening means, and for example could be attached by a moulded feature. The spring plate 109 includes a dimple depression 122 in the plate, and has a curved distal end forming an abutment surface 115. The spring plate carrier 121 includes a pair of projecting spigots 127 at one end of the spring plate carrier which are engaged within corresponding apertures (not shown) in the housing 113 to thereby pivotally mount the spring plate carrier 121, and so spring plate assembly 124 and spring plate 109, so that it can pivot about a pivot axis 128. The spring plate carrier 121 also includes a projecting arm portion 137, extending below the spring plate 109 and away from the end of the carrier 121 having the spigots 127.

The indicator 101 also comprises an adjuster 112. The adjuster 112 comprises an adjuster cam 129 is rotatably mounted to the housing 113 about an axis 130 perpendicular to the spigot axis 128 by means of a circular knob 131 located in a hole 132 in the housing 113. The adjuster cam 129 comprises a circular disc portion 133 which is mounted on and rotationally fixed (for example via suitable splines), to the adjuster knob 131 and is rotatably mounted to the housing 113. A depending skirt 134 extends in an axial direction and to varying axial depths dmax, dmin around the periphery of the circular disc 128. An end edge surface 135 of the depending skirt 134 is thereby disposed at a varying distance d from the disc portion 133 of the adjuster cam 129. The end edge 135 of the depending skirt 134 abuts against a distal end 136 of the projecting arm portion 137 of the spring carrier 121. By rotating the adjuster knob 131, and so adjuster cam 129, the portion of the end edge 135 of the depending skirt 134 which abuts against the distal end 136 of the carrier arm 137 can be varied, thereby varying the distance from the housing 113 at which the arm 137 is held and so pivoting and varying the angle of the spring plate assembly 124 within the housing 113. This can be seen from FIGS. 5 and 6 which show the adjuster cam 129, and spring plate 109 in respective minimum and maximum angles and settings. In this way by rotating the knob 131 a user can adjust the tension F, and so extension, at which the indicator 101 emits the first acoustic click.

A number of variations to the embodiments discussed above are possible. For example, in the above embodiments, the spring plate 9,109 is formed of spring steel, although other materials could also be used. For example, the spring plate 9,109 may be constructed from a number of parts, such as a resilient component for providing the bias and a sound producing component for providing the acoustic signal. Moreover, instead of a plate configuration, the clicker could alternatively take the form of a moveable membrane connected to an abutment formation and adapted to emit an acoustic signal. Similarly while in the described embodiments the spring plate comprises a depression to provide the bistable stress-strain states it will be appreciated that other configurations are possible and other means may be used to produce acoustic click in particular in such a mechanical fashion.

The indicator 1 device may also be used in conjunction, or incorporate an audio monitor able to detect the audio signal produced by the tension indicator. The audio monitor could then include a counter to count the audible signals and so number of extensions of the device. Preferably the audio monitor subjects the signal to analysis in the time and frequency domain to differentiate it from the background noise.

While in the described embodiments the exercise device 20 comprises an elastic strap 6 which provides a tension resistance force against a user extending and stretching the strap 6, and that this is the preferred arrangement, it will be appreciated that the resilient force member could be compressible, rather than tensionable, and provides a resistance to compression. For example the resilient force member could be a spring and the exercise device a 'bull worker' type device. The indicator 1 would then of course have to be suitably modified to respond to the compressive forces rather than the extension force. In addition while the invention has been specifically described with reference to this particular preferred exercise device arrangement it will be appreciated that it can be applied to other exercise device arrangements which include a resilient force member which is operated over an operating range and at different forces. Indeed the indicator 1 could be used and incorporated in a multiplicity of different exercise devices.

The principle and mode of operation of this invention have been explained and illustrated in its preferred embodiment. However, it must be understood that this invention may be practiced otherwise than as specifically explained and illustrated without departing from its spirit or scope.

The invention claimed is:

1. An exercise device comprising:

a resilient force member arranged to be acted on by a user and provide resistance against movement by a user over an operative range; and an indicator device comprising an audible signal producing member having first and second physical configurations, and which is acted on by the resilient force member, in use, to change the physical configuration of the audible signal producing member, wherein the change in physical configuration creates an audible signal, and the audible signal producing member having a bistable stress-strain state, and the first and second physical configurations comprising first and second stable stress strain states of the audible signal producing member;

wherein the audible signal producing member comprises a deflection member, and the resilient force member acts on the deflection member to deflect the deflection member; and wherein the deflection member comprises a plate formed to so as to have a concavity or other structure which is invertable when the deflection plate is bent to define the first and second physical configurations.

2. The exercise device of claim 1 wherein the change in physical configuration of the audible signal producing member occurs rapidly to create the audible signal.

3. The exercise device of claim 1 wherein the audible signal producing member creates an audible signal both as it changes from the first to the second physical configuration and as it changes from the second to the first physical configuration.

4. The exercise device of claim 1 wherein the audible signal producing member is adapted to change from the first to the second physical configuration when acted on by a load above a first threshold.

5. The exercise device of claim 4 wherein the audible signal producing member is adapted to remain in the second physical configuration only when acted on by a load above the first threshold.

6. The exercise device of claim 4 wherein the audible signal producing member is adapted to change back from the second to the first physical configuration when acted on by a load below a second threshold.

7. The exercise device of any of claim 1 wherein the audible signal producing member is adapted to change from the first to the second physical configuration when acted on by a load at a first threshold, and to change from the second to the first physical configuration when acted on by a load at a second threshold, wherein the first and second load thresholds are different.

8. The exercise device of claim 7 wherein the second load threshold is less than the first load threshold.

9. The exercise device of claim 1 further comprising an adjuster for adjusting when, under the action of the resilient force member, the audible signal producing member changes from the first to the second physical configuration.

10. The exercise device of claim 1 wherein the audible signal producing member is biased toward the first physical configuration.

11. The exercise device of claim 1 wherein the indicator comprises a housing within which the audible signal producing member is mounted.

12. The exercise device of claim 1 wherein the first and second stable stress strain states correspond to first and second resistance forces provided by the resilient force member.

13. The exercise device of claim 1 wherein the first and second stable stress strain states correspond to first and second lengths of the resilient force member.

14. The exercise device of claim 1 wherein the bistable audible signal producing member is acted on by the resilient force member, in use, to change the physical configuration of the audible signal producing member, wherein the change in physical configuration creates the audible signal.

15. The exercise device of claim 1 wherein the resilient force member is extendable over the operative range to provide resistance against movement by a user.

16. The exercise device of claim 1 wherein the resilient force member is compressible over the operative range to provide the resistance against movement by a user.

17. The exercise device of claim 1 wherein the resilient force member comprises a resilient portion connected to a non-resilient inextensible portion.

18. The exercise device of claim 1 wherein the resilient force member is connected in series with the indicator device.

19. An exercise device comprising:

a resilient force member arranged to be acted on by a user and provide resistance against movement by a user over an operative range; and an indicator device comprising an audible signal producing member having first and second physical configurations, and which is acted on by the resilient force member, in use, to change the physical configuration of the audible signal producing member, wherein the change in physical configuration creates an audible signal, and the audible signal producing member having a bistable stress-strain state, and the first and second physical configurations comprising first and second stable stress strain states of the audible signal producing member;

wherein the audible signal producing member comprises a deflection member, and the resilient force member acts on the deflection member to deflect the deflection member; and wherein the resilient force member acts on the deflection member at an oblique angle to the deflection member, and the device further comprises an adjuster which varies the angle at which the resilient force member acts on the deflection member.

20. An exercise device comprising:

a resilient force member arranged to be acted on by a user and provide resistance against movement by a user over an operative range; and an indicator device comprising an audible signal producing member having first and second physical configurations, and which is acted on by the resilient force member, in use, to change the physical configuration of the audible signal producing member, wherein the change in physical configuration creates an audible signal, and the audible signal producing member having a bistable stress-strain state, and the first and second physical configurations comprising first and second stable stress strain states of the audible signal producing member;

wherein the audible signal producing member comprises a deflection member, and the resilient force member acts on the deflection member to deflect the deflection member; and wherein the deflection member has a dish shaped portion which is invertible when the deflection plate is bent to define the first and second physical configurations.

21. An exercise device comprising:

a resilient force member arranged to be acted on by a user and provide resistance against movement by a user over an operative range; and an indicator device comprising an audible signal producing member having first and second physical configurations, and which is acted on by the resilient force member, in use, to change the physical configuration of the audible signal producing member, wherein the change in physical configuration creates an audible signal, and the audible signal producing member having a bistable stress-strain state, and the first and second physical configurations comprising first and second stable stress strain states of the audible signal producing member;

wherein the audible signal producing member comprises a deflection member, and the resilient force member acts on the deflection member to deflect the deflection member; and wherein the deflection member comprises a plate with a dimple, and the dimple inverts between, and defines, the first and second physical configurations.

* * * * *